United States Patent [19]

Hamel

[11] 4,129,979

[45] Dec. 19, 1978

[54] APPARATUS FOR TWISTING A YARN

[75] Inventor: Edmund Hamel, Romanshorn, Switzerland

[73] Assignee: Evolution S.A., Rorschach, Switzerland

[21] Appl. No.: 775,404

[22] Filed: Mar. 7, 1977

[30] Foreign Application Priority Data

Mar. 9, 1976 [DE] Fed. Rep. of Germany ..... 2609758
Jul. 6, 1976 [DE] Fed. Rep. of Germany ..... 2630357

[51] Int. Cl.[2] ..... D01H 1/16; D01H 1/42; D01H 7/82

[52] U.S. Cl. ..... 57/59; 57/1 R; 57/304; 57/308; 57/352

[58] Field of Search ..... 57/1 R, 34.5, 56, 59, 57/62, 106, 58, 49

[56] References Cited

U.S. PATENT DOCUMENTS

| | | | |
|---|---|---|---|
| 2,064,270 | 12/1936 | Rowe | 57/59 |
| 2,729,050 | 1/1956 | Honig | 57/59 X |
| 2,834,179 | 5/1958 | Nishimura | 57/59 |
| 3,807,159 | 4/1974 | Hamel | 57/62 |
| 3,857,228 | 12/1974 | Nakahara et al. | 57/56 |
| 3,869,852 | 3/1975 | Hamel | 57/59 |
| 3,938,309 | 2/1976 | Grewe | 57/58.49 X |
| 3,969,880 | 7/1976 | Maillefer et al. | 57/59 X |
| 3,973,381 | 8/1976 | Teranishi | 57/56 X |

*Primary Examiner*—Richard C. Queisser
*Assistant Examiner*—Charles Gorenstein
*Attorney, Agent, or Firm*—Karl F. Ross

[57] ABSTRACT

A yarn-twisting apparatus comprises a spindle receiving the supply spool or bobbin, a rotating can or sleeve surrounding the spool and the bobbin, a yarn takeup arrangement for drawing the yarn from the upper end of the can, and a housing surrounding the can. According to the invention, the stationary housing and the upper and lower ends of the spindle are provided with closures which reach close to the spindle at the bottom and form an opening traversed by the yarn at the top. Means is provided for enabling the upper closure to be removed or displaced for ready access to the interior of the housing. The system reduces the power consumption required for twisting the yarn.

17 Claims, 8 Drawing Figures

APPARATUS FOR TWISTING A YARN

FIELD OF THE INVENTION

The present invention relates to a device for twisting a yarn and, more particularly, to improvements in a yarn-twisting device in which the supply spool or bobbin is surrounded by a rotating can or sleeve which, in turn, is enclosed in a stationary housing.

BACKGROUND OF THE INVENTION

In the spinning or twisting of a yarn, a supply spool or bobbin is received on a spindle which can, as described in Swiss Pat. No. CH-PS 454 683, be surrounded by a sleeve or can which rotates with the spindle and is, in turn, surrounded by a stationary housing. In this conventional system, the housing is open at its upper and lower ends.

While this system has been found to be highly advantageous for the spinning of yarn, it has been found that the power consumption for the spinning process is relatively high at each spindle and, when large numbers of spindles are provided on a spindle bench or common support, for driving a common motor, the high power consumption is multiplied.

OBJECT OF THE INVENTION

It is the object of the present invention to provide a system which improves upon the earlier arrangement and permits a reduction in the power consumption for twisting a yarn.

SUMMARY OF THE INVENTION

This object and others which will become apparent hereinafter are attained, in accordance with the present invention, in an apparatus of the type described, namely, an arrangement in which the rotating spindle is provided with a rotating can or sleeve which surrounds the spindle and the bobbin or spool received thereon and is in turn surrounded by a stationary housing, when this housing at its upper and lower ends is substantially closed. The closure at the lower end is provided with a throughgoing opening closely surrounding the spindle and the can or the shaft carrying same, while the closure at the upper end is provided with a throughgoing opening traversed by the yarn and, if desired, formed with a yarn-guiding device. According to a feature of the invention, this upper closure is mounted upon the stationary housing so as to be detachable or openable to afford acess to the interior of the housing, e.g. for changing the supply spool.

Preferably the can and the surrounding housing are cylindrical and are disposed concentrically, i.e. the can is disposed coacially within the housing. Thus the upper closure member can be a circular disk provided with a central opening traversed by the yarn. Advantageously, at the upper end of the housing slit- or slot-like windows are provided at a level such that a torn yarn under the effect of centrifugal force can pass through these windows and be torn off on the edges thereof.

The rotating can may be formed in various ways within the concepts of the present invention. For example, it can be provided with a cover as, for example, generally described in Swiss Pat. No. CH-PS 454 683. Alternatively, the can may have the configuration of German Open Application DT-OS 23 10 0002.

In a preferred embodiment of the invention, the upper closure is hinged to the housing with a pivot axis in a horizontal plane, the pivot axis being parallel to the longitudinal bank of spindles provided on the machine. In other words, when an assembly or row of such spindles is provided on a common support on the spinning or twisting machine, the pivot axes of the upper closures of all of the housings are aligned in the longitudinal direction, i.e. parallel to the row.

When a multiplicity of such devices is provided on a common spindle support as a spindle bank, the stationary housing for each of the spindles and their rotating cans can, in turn, be received in a common enclosure. The common enclosure can fullfill several functions. For example, it can form an acoustic enclosure to control noise and for this purpose can be constituted from a sound-absorbing material. It can, in addition or alternatively, serve as a collecting and suction space for dust particles and pieces of yarn and thus can be provided with a suction line. The suction removal of dust is more effective when the interior of the enclosure communicates with the space between each can and the surrounding housing via the aforementioned windows therein and the enclosure is provided with a dust-suction means, e.g. a vacuum pump.

According to still another feature of the invention, the spindle is provided with a mandrel which can extend axially through the cover of the can or an opening therein and through the opening of the upper closure member with clearance, the yarn passing in at least one complete turn and preferably a plurality of turns about this mandrel as it emerges through the opening in the housing. This embodiment can be provided, in addition, with a cover for the rotating can as described, for example, in German Pat. No. DT-PS 2 126 196. However, it is also possible, in accordance with the present invention, to provide the mandrel upon a spindle and to have the latter pass through the opening in the upper closure of the stationary housing, obviating the need for a special cover for the can.

For effective distribution of the twist over the yarn, it is advantageous, in accordance with another feature of the invention, to provide above the upper closure member, a stationary yarn guide over which the yarn passes to an oscillating yarn guide which lays the yarn back and forth into a takeup spool or yarn package of the yarn takeup arrangement.

The yarn guide can thus be swingable or removable with the upper closure member while the oscillating thread guide and the takeup arrangement can be provided either at such height above the upper closure member that the latter can be removed or swung into its open position to permit the supply spool or bobbin to be inserted and the bobbin core to be removed, or, if sufficient space is not available, the oscillating yarn guide and the takeup arrangement can be shiftable to clear the cover when the latter is open.

According to another feature of the invention, a thread-deflecting device can be mounted upon the upper closure member or cover so as to be adjustable as to height. The latter device can be F-shaped whereby the long leg of the F is vertically adjustably mounted upon the upper closure member or cover and the transverse legs serve as yarn-deflecting bars. The transverse legs are preferably offset relative to one another in a horizontal direction. Advantageously, the thread- or yarn-deflecting device can be fastened on an eye of the cover traversed by the yarn.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
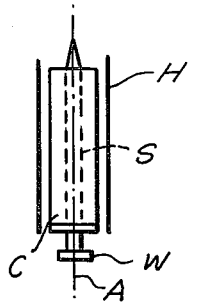
FIG. 1 PRIOR ART
FIG. 1 is a diagram of an apparatus of a prior-art type as described, for example, in Swiss Pat. No. CH-PS 454 683.

FIG. 1 illustrates diagrammatically a yarn-twisting device of the type described in Swiss Pat. No. CH-PS 454 683 while FIG. 2, in similar diagrammatic form, illustrates a spindle arrangement according to the present invention. In the prior-art arrangement of FIG. 1, it can be seen that the usual whorl W which is driven by a belt or the like, carries a spindle S upon which the bobbin with the yarn to be twisted is mounted and is surrounded by a rotating can C, the latter being spacedly surrounded by a housing H which is stationary. In this prior-art arrangement, the housing H is open at its bottom and its top in the axial direction, the axis being represented at A.

Figure 2:
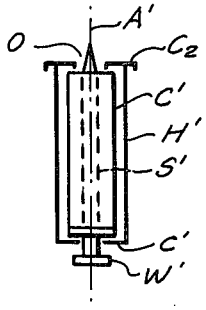
FIG. 2 is a corresponding view of a device according to the present invention.

In the embodiment of FIG. 2, the whorl 2' carries the spindle S' and the can C' as described for the prior-art arrangement of FIG. 1, all being rotatable about the axis A' while being spacedly surrounded by the housing H' which is stationary. In contrast to the device of FIG. 1, the system of the present invention illustrated in FIG. 2 comprises a bottom closure $C_1$ reaching inwardly toward the spindle S' and thereby closing the space between the can C' and the housing H' at the bottom. At its top, the housing H' is provided with a removable closure $C_2$ formed with a central opening O through which the spindle mandrel passes and the yarn to be twisted emerges. The closure $C_2$ (i.e. removable or openable cover) reaches inwardly to leave only a small clearance through which the yarn can emerge.

Comparative tests between the arrangements of FIGS. 1 and 2 have been carried out and are described below. In all of the tests, except for the results given in Tables I and II for the devices of FIGS. 1 and 2, respectively, and the use of upper and lower covers $C_1$ and $C_2$ in the device of FIG. 2, the devices were identical. In both cases, the spindle had a conically pointed mandrel extended above the can. In the Tables, the headings have the following significance:

n-spdl. = the rotating speed of the spindle;
n-Motor = speed of the motor;
Volt = terminal voltage at the motor;
Amp = current consumption of the motor; and
N-spdl. = power consumption of the device.

TABLE I

| n-spdl. RPM | n-motor RPM | Volt V | Amp. A | N-spdl. Watt |
|---|---|---|---|---|
| 7,000 | 1,420 | 131 | 0.63 | 44.48 |
| 8,000 | 1,620 | 150 | 0.71 | 59.57 |
| 9,000 | 1,820 | 169 | 0.83 | 82.31 |
| 10,000 | 2,025 | 188 | 0.92 | 104.51 |
| 10,500 | 2,125 | 198 | 0.99 | 119.97 |

TABLE II

| n-spld. RPM | n-motor RPM | Volt V | Amp. A | N-spdl. Watt |
|---|---|---|---|---|
| 7,000 | 1,420 | 131 | 0.545 | 33.34 |
| 8,000 | 1,620 | 150 | 0.62 | 46.07 |
| 9,000 | 1,820 | 169 | 0.72 | 63.72 |
| 10,000 | 2,025 | 188 | 0.84 | 89.47 |
| 10,500 | 2,125 | 198 | 0.89 | 100.17 |

The yarn carried by the supply spool amounted to 1.5 kg.

Comparing the results obtained, it can be seen that there is, at low speeds, a reduction in power consumption of up to 25% and, at high speeds, a reduction in power consumption of close to 20%.

Figure 3:
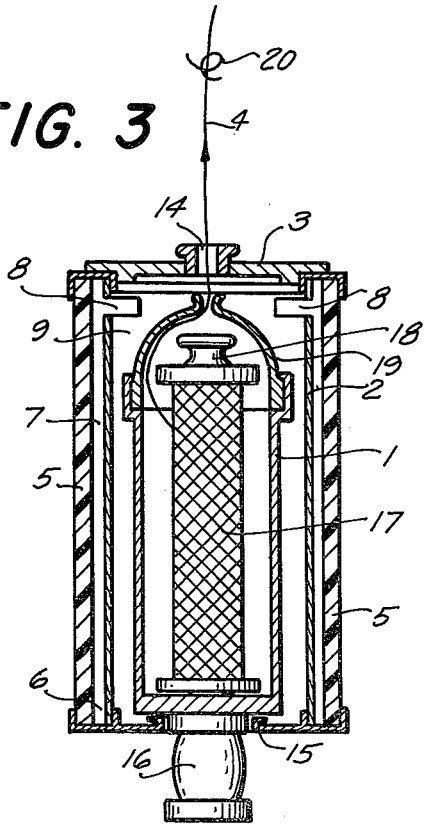
FIG. 3 is a vertical (axial) cross-section through a yarn-twisting device according to one embodiment of the invention.

In FIG. 3, I have shown an apparatus in accordance with one embodiment of the invention. Throughout the drawing, similar reference numerals are used to designate similarly functioning and constructed parts.

The whorl 16 is driven by a belt in the conventional manner, the belt engaging the whorls of an entire row of twisting devices arranged in a longitudinally extending spindle bank. The whorl 16 carries a spindle upon which is received a supply spool 17 of yarn having a knob 18 at its upper end to enable the core of the spool to be withdrawn for replacement by a full spool and the insertion of the full spool onto the spindle. The spindle is surrounded by a spindle can 1 which is rotatably entrained with the spindle. The upper end of the can 1 is closed by a cover 19 having a throughgoing axial opening through which the yarn 4 emerges. The can 1 and the cover 19 are, in turn, closely surrounded by a stationary housing 2. The can 1 is of cylindrical configuration, i.e. has a circular cross-section, and is disposed coaxially within the cylindrical housing 2 which likewise has a circular cross-section. The space between the housing 2 and the can 1 is closed at its bottom by a lower closure member 15 which reaches inwardly substantially to the top of the whorl permitting only a small clearance to remain between this lower closure and the whorl 16. At its upper end, the housing 2 is closed by a lid or cover 3 which is provided with an eye 14 through which the yarn 4 passes, the eye 14 being axially aligned with the opening in the cover 3. The yarn 4 passes through a stationary yarn guide 20 and then to an oscillating yarn guide which distributes the yarn back and forth upon a yarn package of a yarn takeup arrangement not shown.

Figure 5:
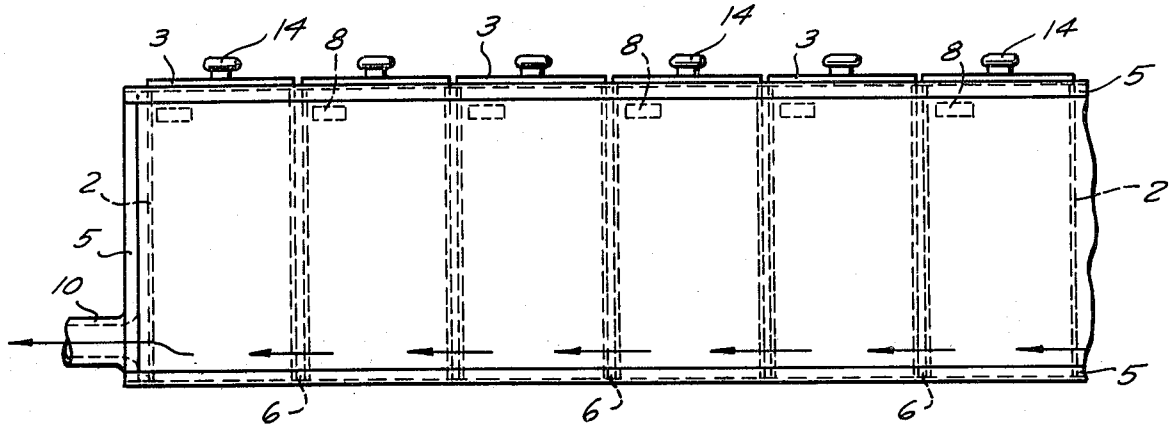
FIG. 5 is a partial elevational view of a system according to the present invention provided with a plurality of units of the type described in connection with either FIG. 3 or FIG. 4 in a common spindle bank, all received in a common evacuatable enclosure.
Figure 6:
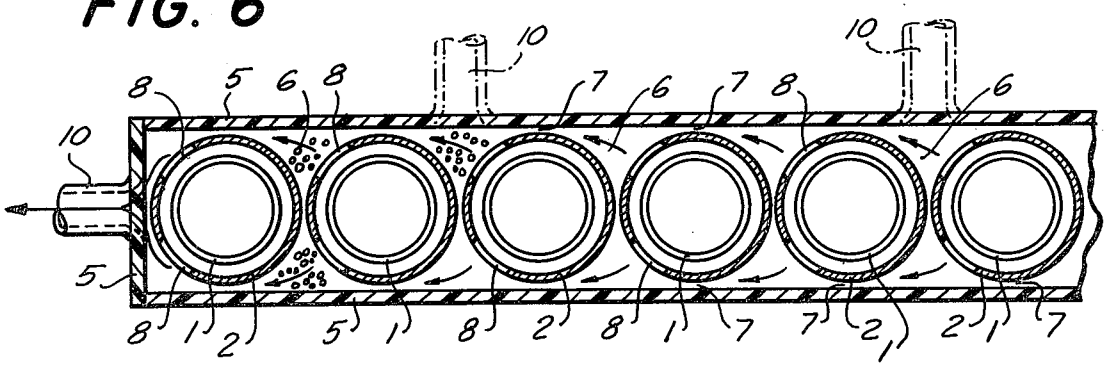
FIG. 6 is a horizontal cross-section, viewed from above, through the system of FIG. 5.

A multiplicity of such devices is provided on a spindle bank in a row as illustrated in FIGS. 5 and 6, the devices being received within a common enclosure 5 which is composed of sound-absorbing material. The housing 5 is connected to an air-suction line 10 which, in turn, runs to a suction pump adapted to evacuate the interior of the enclosure 7. The suction line 10 can be provided at one axial end of the assembly, as has been illustrated in solid lines, although additional suction lines can be provided as shown in dot-dash lines at intermediate locations along the assembly in addition or alternatively.

The gaps 7 between the housings 2 of each device and the enclosure 5 communicate with the space 6 within this enclosure which can be evacuated via the lines 10 and hence free from dust.

To ensure communication between the evacuated space within the enclosure 5 and the space between each can 1 and the respective housing 2, the latter is provided at its upper end with peripherally extending slits 8 (FIG. 3) which serve the additional function of permitting broken yarn which is centrifugally displaced outwardly in a radial direction to pass through these slits and tear along the edges thereof. The suction withdraws the yarn pieces thus formed together with any dust or other material, e.g. dye particles, fluff and textile finishing residues.

Figure 4:
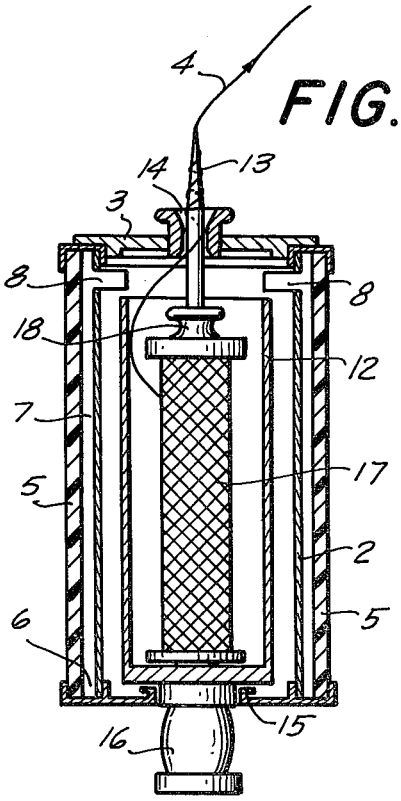
FIG. 4 is an axial cross-sectional view through a yarn-twisting device illustrating a second embodiment of the invention.

The embodiment of FIG. 4 differs from that of FIG. 3 in that the can 12 which rotates with the spindle and the spool 17 is not provided with a cover while the spindle has a mandrel 13 which passes through the eye 14 and has an upwardly pointed conical extremity along which the yarn passes spirally in a plurality of turns. The suction of air has the additional effect that it reduces the air pessure in the space 9 between the can 1 and the housing 2 and thus reduces the air friction on the surface of the rotating can 1. The frictional heat in this region, which results in a heating of the air which sucked out of the region 9, can be recovered by using this air for room heating.

Figure 7:
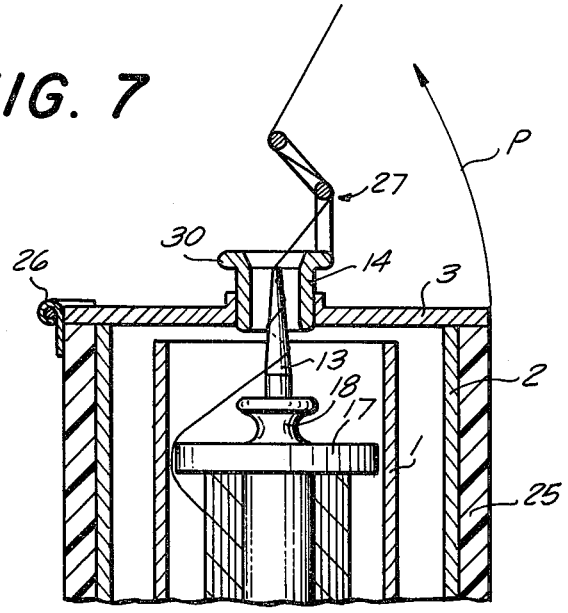
FIG. 7 is a partial axial cross-sectional view through another embodiment of the present invention in which the swingable cover of the stationary housing is provided with a thread guide device of F configuration.
Figure 8:
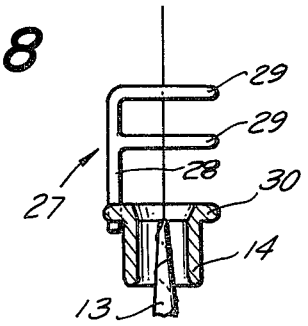
FIG. 8 is an elevational view of the thread guide of FIG. 7, partly in cross-section, and seen in a direction 90° offset from the direction of the view of FIG. 7.

FIGS. 7 and 8 show an embodiment of the invention in which the spindle is provided with a point 13 which terminates within the eye 14 in the cover 3 of the housing 2. In this case, the housing 2 is encased in a sound-absorbing layer 25 and carries the cover 3 directly, i.e. via a hinge 26 which permits the cover 3 to be swung upwardly in the direction of arrow P to afford access to the spool 17 for replacement of the core by a new spool.

Upon the eye 14, there is provided an F-shaped thread guide 27 comprising a long shank 28 extending parallel to the axis of the device and carrying a pair of cantilevered transverse legs 29 which are horizontally offset from one another as can be seen from FIG. 7. The yarn passes over the lower shank 29 and under the upper shank 29 in a Z configuration. The shank 28 is vertically received with friction in a bore in an outwardly extending flange 30 of the eye 14 so as to be vertically adjustable.

It will be apparent from FIGS. 7 and 8 that the cover 3 can be swung into an open position without impediment by the mendrel point 13 when the latter only extends partly into the eye 14. Since the thread guide 27 is fixed to the cover 3, it also does not impede the opening of the cover. The hinge 26 is preferably so oriented that the pivot axis, which is perpendicular to the plane of the paper in FIG. 7, extends parallel to the longitudinal dimension of the machine, i.e. horizontally along the spindle bank.

The operator can stand to the right (FIG. 7) facing the spindle bank and simply lift the cover 3 rearwardly to afford access to the spool within the device. The mandrel 13 acts as a twist brake which limits the twisting region to the space between the mandrel 13 and the takeup arrangement, preventing the twist from running backwardly to the spool 17 and impeding free payoff of the yarn from the spool.

While all of the embodiments illustrated have closures at the upper and lower ends of the housings, it will be apparent that an improvement in power consumption will result when only the upper end or only the lower end is provided with such a closure. In either case there is a reduction of consumption, although not to the degree obtained when closures are provided at both the upper and lower ends.

I claim:

1. A device for twisting a yarn, comprising:
a spindle adapted to receive a supply spool of a yarn to be twisted and rotatable about an axis;
means for rotating said spindle about said axis;
a can surrounding said spindle and a spool adapted to be carried thereby and coupled with said spindle for rotation therewith about said axis;
a stationary housing closely surrounding said can; and
a closure member on at least one axial end of said housing reaching inwardly toward said axis and closing the space between said housing and said can at said one end to reduce power consumption in the twisting of a yarn paid off from said spool and emerging from said can and said housing at and end thereof, said axis being generally upright and said yarn emerging from the upper end of said can, said closure member being a cover displaceably mounted upon said housing, formed with an opening traversed by said yarn, and openable to afford access to the interior of said housing and said can, said can and said housing being cylindrical and coaxial with one another and said cover being a circular disk, said opening being provided at the center of said disk.

2. The device defined in claim 1 wherein said housing is provided at said upper end with at least one peripherally extending slit.

3. The device defined in claim 1 wherein said can is provided at said upper end with a cap formed with an opening aligned with the opening in said cover.

4. The device defined in claim 1, further comprising a hinge having a horizontal pivot axis swingably mounting said cover to enable the displacement of same.

5. The device defined in claim 4 wherein said hinge is disposed between said cover and said housing.

6. The device defined in claim 4 wherein the axis of said hinge lies parallel to a row of such spindles on a common machine bank.

7. The device defined in claim 1, further comprising an enclosure surrounding said housing.

8. The device defined in claim 7 wherein said housing is composed at least in part of sound-absorbing material.

9. The device defined in claim 7 wherein said enclosure defines a first space with said housing communicating with a second space between said housing and said can, said device further comprising means for evacuating said enclosure.

10. The device defined in claim 1 wherein said spindle is provided with an upwardly converging pointed mandrel extending at least partly into said opening in said cover, said yarn passing spirally around said mandrel.

11. The device defined in claim 1, further comprising a stationary yarn guide spaced above said cover.

12. The device defined in claim 11 wherein said guide is disposed sufficiently above said cover to enable the displacement of said cover from above said can to facilitate withdrawal of a spool core and the insertion of a spool into said can.

13. The device defined in claim 11 wherein said yarn guide is shiftable to clear said cover.

14. The device defined in claim 1, further comprising a yarn-deflection element mounted on said cover and vertically displaceable thereon.

15. The device defined in claim 14 wherein said element is of F configuration and has a long leg displaceable on said cover and a pair of transverse legs projecting from said long leg and around which said yarn passes.

16. The device defined in claim 15 wherein said transverse legs are horizontally offset from one another.

17. The device defined in claim 14 wherein said opening in said cover is provided with a thread-guide eye and said element is mounted on said eye.

* * * * *